US007103295B2

(12) United States Patent
Takura et al.

(10) Patent No.: US 7,103,295 B2
(45) Date of Patent: Sep. 5, 2006

(54) IMAGE FORMING APPARATUS SUPPLYING TONER EFFICIENTLY TO CLEANING MEANS CLEANING SURFACE OF IMAGE BEARING MEMBER

(75) Inventors: Keizo Takura, Kanagawa (JP); Hiroyuki Kidaka, Ibaraki (JP); Koji Arimura, Ibaraki (JP); Hisataka Hisakuni, Ibaraki (JP); Makoto Oki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/937,310

(22) Filed: Sep. 10, 2004

(65) Prior Publication Data

US 2005/0089342 A1 Apr. 28, 2005

(30) Foreign Application Priority Data

Sep. 22, 2003 (JP) ..... 2003-330056

(51) Int. Cl.
*G03G 15/16* (2006.01)

(52) U.S. Cl. ..... 399/66; 399/71; 399/88

(58) Field of Classification Search ..... 399/66, 399/71, 88, 302, 308, 310, 314, 346
See application file for complete search history.

(56) References Cited

U.S. PATENT DOCUMENTS 6,321,059 B1 * 11/2001 Tamura ..... 399/297
2003/0063928 A1 * 4/2003 Matsuguma ..... 399/299
2004/0091276 A1 * 5/2004 Yoshida et al. ..... 399/38

FOREIGN PATENT DOCUMENTS

| | | |
|---|---|---|
| JP | 5-224497 | 9/1993 |
| JP | 7-219398 | 8/1995 |
| JP | 11-119626 | 4/1999 |
| JP | 11-202709 | 7/1999 |
| JP | 2002-323803 | 11/2002 |

* cited by examiner

*Primary Examiner*—Arthur T. Grimley
*Assistant Examiner*—Laura K. Roth
(74) *Attorney, Agent, or Firm*—Fitzpatrick, Cella, Harper & Scinto

(57) ABSTRACT

An image forming apparatus includes an image bearing member that bears a toner image; an intermediate transferring material; a transferring unit that transfers a toner image on the image bearing member to the intermediate transferring material; a bias applying unit that applies a bias to the transferring unit; a cleaning unit that contacts and cleans the surface of the image bearing member; a toner supplying unit that, when an image is not being formed, passes a toner image for supply that is formed on the image bearing member through a transferring position to supply the toner image for supply to the cleaning unit; and a switching unit that switches from a state in which the power supply portion is electrically connected to the bias applying unit to a state in which a resistance value between the power supply portion and a ground is 100 MΩ or more.

13 Claims, 6 Drawing Sheets

IMAGE FORMING APPARATUS SUPPLYING TONER EFFICIENTLY TO CLEANING MEANS CLEANING SURFACE OF IMAGE BEARING MEMBER

BACKGROUND OF THE INVENTION

1. Field of the Invention

The present invention relates to an image forming apparatus having a toner supplying means that supplies toner to a cleaning means that cleans the surface of an image bearing member.

2. Related Background Art

In recent years, stable image formation is sought in image forming apparatuses using an electrophotographic method. One factor that is necessary to achieve stable image formation is stable cleaning of the surface of an image bearing member.

When bias is applied to the power supply portion of a transferring means, a toner image formed on an image bearing member is transferred to an intermediate transferring material or recording material in the transferring position.

After transfer, a blade member that comes into contact with the image bearing member is preferably used as means for cleaning the surface of the image bearing member. The reason being is that such a configuration is simple.

However, when a blade member comes into contact with an image bearing member as a cleaning means, a problem exists in that the blade member is rolled up when low density images are formed continuously, and therefore cleaning cannot be adequately performed.

Therefore, at a time when an image is not formed, a toner image for supply is formed on an image bearing member and toner is supplied to the cleaning means. In addition, in order to efficiently supply toner to the cleaning means, when the toner image for supply passes through a transferring position, a bias applied to the power supply portion of the transferring means is turned OFF (0 V).

However, even when the bias applied to the power supply portion of the transferring means is turned OFF (0 V) when the toner image for supply passes through the transferring position, most of the toner of the toner image for supply is transferred to an intermediate transferring material or the like in the transferring position. Thus, the problem exists that sufficient toner is not supplied to the cleaning means.

SUMMARY OF THE INVENTION

Therefore, it is an object of the present invention to provide an image forming apparatus that forms a toner image for supply on an image bearing member to supply toner to a cleaning means, wherein transfer of the toner image for supply to an intermediate transferring material or the like is controlled to supply sufficient toner to the cleaning means.

It is another object of this invention to provide an image forming apparatus having: an image bearing member bearing a toner image; an intermediate transferring material that contacts with the image bearing member;

transferring means that transfers a toner image on the image bearing member to the intermediate transferring material at a transferring position; bias applying means that applies bias to a power supply portion of the transferring means in a time period in which transfer is performed by the transferring means;

cleaning means that contacts to the image bearing member and cleans a surface of the image bearing member;

toner supplying means that, at a time when an image is not being formed, passes a toner image for supply formed on the image bearing member through the transferring position to supply the toner image for supply to the cleaning means; and switching means that switches from a state in which the power supply portion is electrically connected to the bias applying means to a state in which a resistance value between the power supply portion and a ground is equal to or greater than 100 MΩ;

wherein, a state when the toner image for supply on the image bearing member passes through the transferring position is the state where the resistance value is equal to or greater than 100 MΩ.

It is a further object of this invention to provide an image forming apparatus having: an image bearing member bearing a toner image; a recording material carrying member that carries a recording material and can contact with the image bearing member;

transferring means that transfers a toner image on the image bearing member to a recording material carried on the recording material carrying member in a transferring position;

bias applying means that applies bias to a power supply portion of the transferring means in a time period in which transfer is performed by the transferring means;

cleaning means that contacts to the image bearing member and cleans a surface of the image bearing member;

toner supplying means that, at a time when an image is not being formed, passes a toner image for supply formed on the image bearing member through the transferring position to supply the toner image for supply to the cleaning means; and switching means that switches from a state in which the power supply portion is electrically connected to the bias applying means to a state in which a resistance value between the power supply portion and a ground is equal to or greater than 100 MΩ;

wherein, a state when the toner image for supply on the image bearing member passes through the transferring position is the state where the resistance value is equal to or greater than 100 MΩ.

It is a still further object of this invention to provide an image forming apparatus having:

an image bearing member bearing a toner image;

transferring means that transfers a toner image on the image bearing member to a recording material in a transferring position;

bias applying means that applies bias to a power supply portion of the transferring means in a time period in which transfer is performed by the transferring means;

cleaning means that contacts to the image bearing member and cleans a surface of the image bearing member;

toner supplying means that, at a time when an image is not being formed, passes a toner image for supply formed on the image bearing member through the transferring position to supply the toner image for supply to the cleaning means; and switching means that switches from a state in which the power supply portion is electrically connected to the bias applying means to a state in which a resistance value between the transferring means and a ground is equal to or greater than 100 MΩ;

wherein, a state when the toner image for supply on the image bearing member passes through the transferring position is the state where the resistance value is equal to or greater than 100 MΩ.

DESCRIPTION OF THE PREFERRED EMBODIMENTS

Figure 1:
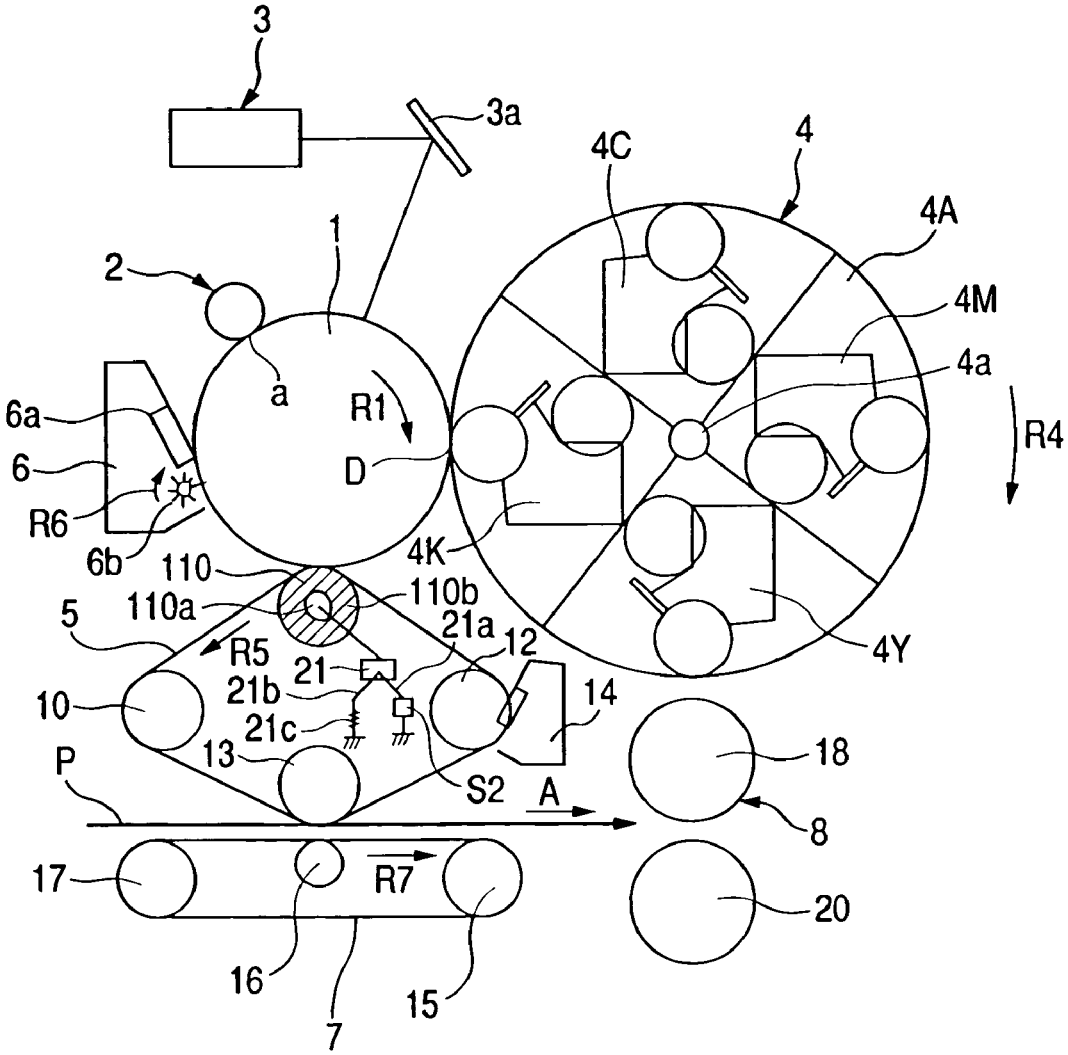
FIG. 1 is a longitudinal section that schematically shows an outline configuration of an image forming apparatus of this invention.

In the present invention, by making a resistance value between a power supply portion of a transferring means and a ground enter a state where the resistance value is equal to or greater than 100 MΩ when a toner image for supply on an image bearing member passes through a transferring position, transfer of the toner image for supply to an intermediate transferring material or the like is prevented, and sufficient toner is supplied to a cleaning means.

That is, the surface of a toner image for supply that is borne on an image bearing member is at a certain potential as a result of the charge possessed by the toner itself. Thus, a potential difference is generated between the toner image for supply and an intermediate transferring material or the like. Therefore, even if the bias applied to a power supply portion of the transferring means is set to OFF (0 V), current flows from the image bearing member to the transferring means and the toner image for supply is transferred to the intermediate transferring material or the like.

Therefore, in this invention, by making a resistance value between a power supply portion of a transferring means and a ground enter a state where the resistance value is equal to or greater than 100 MΩ when a toner image for supply on an image bearing member passes through a transferring position, flow of current from the image bearing member to the transferring means is prevented. Thus, the transfer of toner image for supply to an intermediate transferring material or the like is prevented, and sufficient toner can be supplied to a cleaning means.

Embodiments of this invention are described in detail hereunder.

Components that are denoted by the same reference characters and reference numerals in the figures are components that have a similar configuration or function, and duplicate explanation has been omitted as appropriate for these components.

Embodiment 1

FIG. 1 shows an image forming apparatus of Embodiment 1 as one example of an image forming apparatus according to the present invention. The image forming apparatus shown in the figure is an electrophotographic, four-color, full color printer, and the figure is a view that schematically shows the outline configuration thereof.

The configuration of the printer (hereunder, referred to as "image forming apparatus") will be described by referring to the figure.

The printer (hereunder, referred to as "image forming apparatus") shown in the figure comprises a drum-type electrophotographic photosensitive member (hereunder, referred to as "photosensitive drum") 1 as an image bearing member. The photosensitive drum 1 is supported to rotate freely in the direction of an arrow R1. In the area surrounding the photosensitive drum 1 are provided, in rough order from the upstream along the direction of rotation thereof, a primary charging device (charging means) 2, an exposing apparatus (exposing means) 3, a developing apparatus (developing means) 4, an intermediate transferring belt (intermediate transferring material) 5, and a cleaning apparatus (cleaning means) 6. Further, below the intermediate transferring belt 5 is provided a transfer conveying belt 7, and on the downstream side of transfer conveying belt 7 along the conveying direction (direction of arrow A) of a recording material P, a fixing apparatus (fixing means) 8 is provided.

In this embodiment, a photosensitive drum of a diameter of 60 mm is used as the above photosensitive drum 1.

Figure 2:
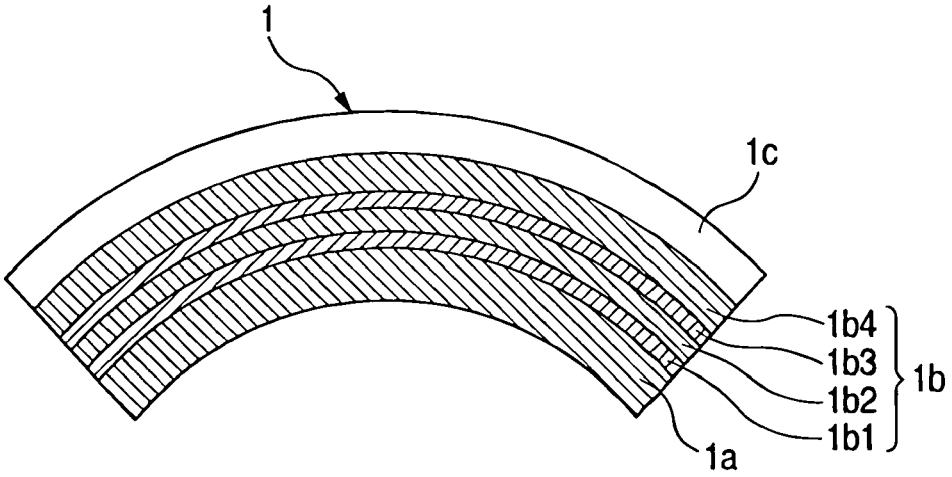
FIG. 2 is a longitudinal section that schematically shows the layered formation of a photosensitive drum.

As shown in FIG. 2, the photosensitive drum 1 comprises a drum base 1*a* made of conductive material such as grounded aluminum on the periphery of which a photosensitive layer 1*b* comprising a conventional organic photoconductor (OPC) layer is formed by application, on which a protective layer (OCL) 1*c* with excellent abrasion resistance properties is formed by application. Of these, the photosensitive layer 1*b* is composed of the following four layers: an under coating layer (CPL) 1*b*1, an injection prevention layer (UCL) 1*b*2, a charge generation layer (CGL) 1*b*3, and a charge transport layer (CTL) 1*b*4. The photosensitive layer 1*b* is normally an insulator, and has a characteristic of functioning as a conductive material upon irradiation with a light of a specific wavelength. This is because positive holes (electron pairs) are generated inside the charge generation layer 1*b*3 by photo-irradiation, and these become the bearers of a flow of electrical charges. The charge generation layer 1*b*3 comprises a phthalocyanine compound of a thickness of 0.2 μm, and the charge transport layer 1*b*4 comprises polycarbonate of a thickness of approximately 25 μm in which is dispersed a hydrazone compound. The photosensitive drum 1 is driven to rotate in the direction of arrow R1 at a predetermined process speed (peripheral velocity) by driving means (not shown).

Figure 3:
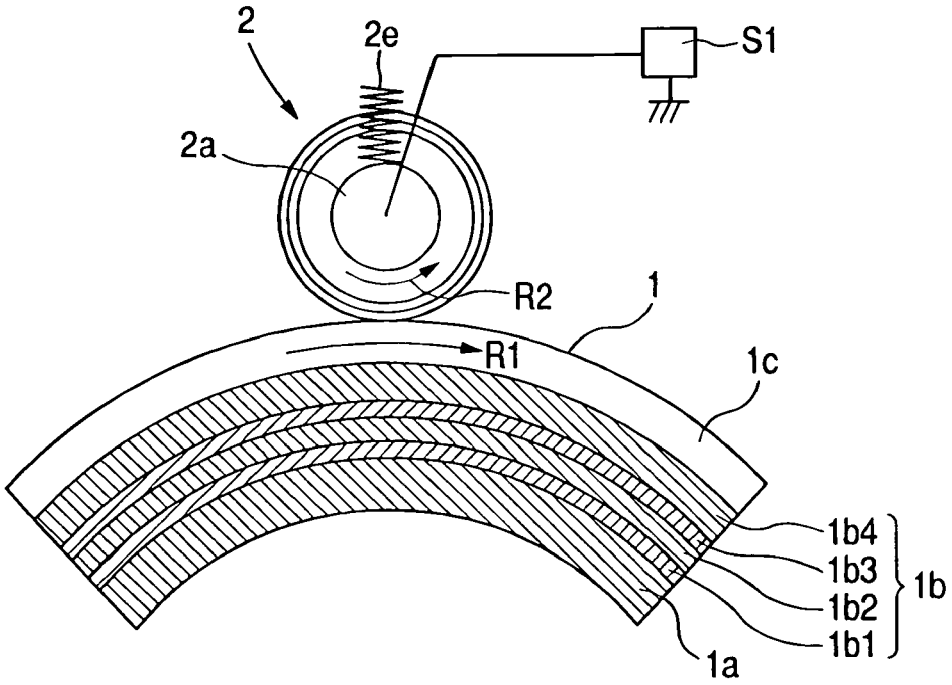
FIG. 3 is a longitudinal section that shows the constitution of a charging device.

In this embodiment, as shown in FIG. 3, a charging roller (contact charging member) 2 formed in a roller shape is used as the primary charging device 2. The charging roller 2 is a member that uniformly charges the surface (periphery) of the photosensitive drum 1 to a predetermined polarity and potential.

As shown in FIG. 3, the charging roller 2 comprises a cored bar 2*a* whose two ends are respectively supported to rotate freely by a bearing member (not shown). The bearing member is biased towards photosensitive drum 1 by a pressure spring (compression spring) 2*e* as an biasing member, whereby the charging roller 2 is pressure welded with a predetermined pressure against the surface of the photosensitive drum 1 to form a charging portion (charging nip portion) between the charging roller 2 and the surface of the photosensitive drum 1. Accompanying rotation of the photosensitive drum 1 in the direction of the arrow R1, the charging roller 2 is driven to rotate in the direction of an arrow R2.

A charging bias is applied to the charging roller 2 by a charging bias applying power source S1. An oscillating voltage that consists of superimposed direct current voltage and alternating voltage is applied as a charging bias from the charging bias applying power source S1 to the cored bar 2*a* of the charging roller 2. As a result, the surface of rotating photosensitive drum 1 is uniformly charged to a predetermined polarity and potential.

In this embodiment a laser scanner that turns a laser beam ON/OFF in accordance with image information is used as the exposing apparatus 3. A laser beam generated from the exposing apparatus 3 is irradiated via a reflection mirror 3*a* onto the surface of the photosensitive drum 1 after charging. As a result, a charge of a laser beam irradiation portion is eliminated, whereby an electrostatic image is formed.

Further, the developing apparatus 4 employs a rotary developing system. The developing apparatus 4 has a rotating member 4A that is driven to rotate around an axis 4*a* in the direction of an arrow R4 by a motor (not shown), and four developing devices that are mounted thereon, namely a black, yellow, magenta and cyan developing device, 4K, 4Y, 4M and 4C, respectively. When forming a black developer image (toner image) on the photosensitive drum 1, developing is conducted by the developing device 4K for black at a developing position D that adjoins the photosensitive drum 1. Likewise, when forming a yellow toner image the rotating member 4A is rotated 90° to dispose the developing device 4Y for yellow in the developing position D to carry out developing. Formation of magenta and cyan toner images is also carried out in the same manner. In the description hereunder, the term "developing device" is used when there is no particular necessity to distinguish between colors.

The aforementioned intermediate transferring belt 5 traverses a driving roller 10, a primary transferring roller (transferring means) 110, a driven roller 12, and a secondary transferring counter-roller 13, and rotates in the direction of an arrow R5 accompanying rotation of the driving roller 10. A belt cleaner 14 contacts with the intermediate transferring belt 5.

The aforementioned cleaning apparatus (cleaning means) 6 employs a blade cleaning system that contacts the edge of a cleaning blade (blade member) 6*a* made from urethane rubber with the surface of the photosensitive drum 1 to scrape off toner. In this embodiment, the cleaning blade 6*a* is an elastic blade having urethane as a main constituent, and is disposed such that it contacts with the photosensitive drum 1 in the opposite direction (counter direction) to the direction of movement of the surface of the photosensitive drum 1. Further, to enhance cleaning properties and to also fulfill a role of uniformly applying toner as a lubricant to a cleaning blade nip, a fur brush 6*b* is provided on the drum rotation upstream side of the cleaning blade 6*a*. In this embodiment, the fur of the fur brush 6*b* has electrical conductivity and the shape thereof is such that the fur tips face outward from a cored bar that forms the center of rotation. The fur brush 6*b* is disposed such that it contacts with the photosensitive drum 1, and a contacting portion thereof rotates in an opposite direction (the direction of an arrow R6) to the direction of rotation of the photosensitive drum 1.

Further, for implementing the present embodiment, with regard to the position of the cleaning apparatus 6 with respect to the photosensitive drum 1, the cleaning apparatus 6 is provided below a tangent from the position where the photosensitive drum 1 and the cleaning apparatus 6 come into contact, when employing the tangent as a reference, or in a case where the cleaning apparatus 6 is above that tangent, the cleaning apparatus 6 is preferably provided in a condition where an angle formed by the tangent and the vertical direction is within the range of 0° and 45°. The reason for this is that when an opening portion of the cleaning apparatus 6 is disposed downward in the vertical direction waste toner is liable to accumulate in the opening portion, and because of pressure applied to the nip of the cleaning blade 6*a*, there are cases where it is difficult to maintain optimal cleaning conditions.

The aforementioned transfer conveying belt 7 traverses a driving roller 15, a secondary transferring roller 16, and a passive roller 17, and rotates in the direction of an arrow R7 accompanying rotation of the driving roller 15.

The aforementioned fixing apparatus 8 has a fixing roller 18 comprising an built-in heater (not shown) and a pressure roller 20 that is contacted against the fixing roller 18 from a downward direction.

The operation of the image forming apparatus having the aforementioned configuration will now be described.

In FIG. 1, an electrostatic image is formed on the photosensitive drum 1 by exposure of the surface of the photosensitive drum 1 that was charged by the primary charging device 2 by means of the exposing apparatus 3. Toner of a desired color is attached to the electrostatic image by a developing device that stores the developer (toner) to thereby form a toner image on the photosensitive drum 1. This toner image is transferred to the intermediate transferring belt (intermediate transferring material) 5 by the application of a transferring bias from a transfer power source (bias applying means) S2 to a power supply portion 110*a* of the primary transferring roller (transferring means) 110.

The primary transferring roller 110 comprises as the power supply portion 110*a*, a conductive material 10*b* such as foamed urethane provided around a cylindrical member made of metal to form a roller-shaped member.

When a toner image is transferred onto the intermediate transferring belt 5 by the primary transferring roller 110, the power supply portion 110*a* of the primary transferring roller 110 is in a state where it is electrically connected to the transfer power source S2.

When conducting image formation of a four-color full color image, first, a black toner image is formed on the photosensitive drum 1 by the developing device 4K for black, and the black toner image is primary transferred onto the intermediate transferring belt 5. Next, the rotating member 4A is rotated 90° to dispose the developing device 4Y for yellow in the developing position D to form a yellow toner image on the photosensitive drum 1. The yellow toner image is then primary transferred onto the black toner image on the intermediate transferring belt 5 to superimpose it thereon.

This operation is also performed in order for the developing device 4M for magenta and the developing device 4C for cyan to superimpose a toner image of four colors on the intermediate transferring belt 5. Thereafter, by applying a secondary transferring bias to the secondary transferring roller 16, the toner image of four colors on the intermediate transferring belt 5 is secondary transferred in one operation onto a recording material P conveyed thereto on the transfer conveying belt 7.

The recording material P onto which the toner image was transferred is detached from the transfer conveying belt 7 and is heated and pressed by the fixing roller 18 and the pressure roller 20 of the fixing apparatus 8 to fix the toner image to the surface thereof. Thus, a four-color, full color image is formed. After the secondary transfer, toner (residual transfer toner) remaining on the intermediate transferring belt 5 is removed by the belt cleaner 14.

When conducting formation of a one-color image, an electrostatic latent image formed on the photosensitive drum 1 is developed by means of the developing device storing the toner of the desired color. After this toner image is primary transferred onto the intermediate transferring belt 5 it is immediately secondary transferred onto the recording material P. The recording material P onto which the toner image was transferred is detached from the transfer conveying belt 7 and heated and pressed by the fixing apparatus 8 to fix the toner image to the surface thereof.

Meanwhile, a toner (residual transfer toner) 23 that remains on the surface of the photosensitive drum 1 after the primary transfer is cleaned and removed by the cleaning blade 6*a* and fur brush 6*b* of the cleaning apparatus (cleaning means) 6.

Figure 4:
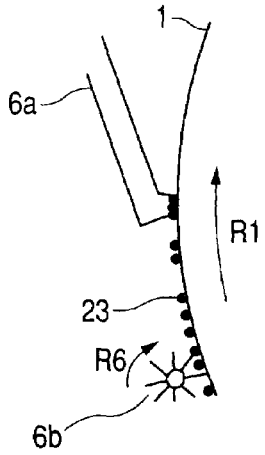
FIG. 4 is a front elevation illustrating a situation where a photosensitive drum is being cleaned by a cleaning blade in the first embodiment herein.

FIG. 4 illustrates a state where the photosensitive drum 1 is being cleaned by the cleaning blade 6*a*. The cleaning blade 6*a* is in a condition where it is constantly in pressurized contact with the surface of the photosensitive drum 1 during the process of forming an image. The residual transfer toner 21 lies between the edge of the cleaning blade 6*a* and the photosensitive drum 1, and fulfills a function as a lubricant to decrease to a certain degree a friction factor between the cleaning blade 6*a* and the photosensitive drum 1. By the provision of the fur brush 6*b*, the supply of a certain level of residual transfer toner of a constant uniformity is further enabled. In addition, by electrically floating the fur brush 6*b*, it is possible to retain a larger quantity of the toner.

However, in cases where only images of a low image ratio are output and the like, in addition to a time of image formation, at an arbitrary timing when an image is not being formed, an operation is conducted to supply toner to the cleaning apparatus 6 as a lubricant.

In this embodiment, at a time when an image is not being formed, a toner image (toner image for supply) as a lubricant of the photosensitive drum 1 and the cleaning apparatus 6 is formed on the photosensitive drum 1 by charging the photosensitive drum 1 (image bearing member) by means of the primary charging device (charging means) 2 to form an electrostatic image on the photosensitive drum 1 by means of the exposing apparatus (exposing means) 3 to develop the electrostatic image using toner from the developing apparatus (developing means, which serves as a toner supply means) 4. Further, by rotation of the photosensitive drum 1, the toner image for supply passes through the nip (transferring position) of the primary transferring roller 110 and the photosensitive drum 1 and is supplied to the cleaning apparatus (cleaning means) 6.

In order to allow the toner image for supply on the photosensitive drum 1 (the toner amount on the photosensitive drum 1 is 0.05 mg/cm$^2$ or more over the total area for which image formation is possible in the longitudinal direction of the photosensitive drum 1 and over an arbitrary width in the direction of rotation of the photosensitive drum) to arrive at the cleaning blade 6*a* and the fur brush 6*b* of the cleaning apparatus (cleaning means) 6 without, as far as possible, transferring the toner image for supply to the intermediate transferring belt 5, in a time period where the toner image for supply passes through the transferring position the apparatus enters a state 21*b* in which a resistance value between the power supply portion 11*a* and a ground is equal to or greater than 100 MΩ, by means of switching means 21 that switches from a state 21*a* in which the power supply portion 110*a* is electrically connected to the transfer power source S2 to the state 21*b* in which the resistance value between the power supply portion 110*a* and the ground is equal to or greater than 100 MΩ. In this embodiment, an electric resistance element 21C with a resistance of 100 MΩ is provided between the ground and the power supply portion 110*a*.

A semiconductor switch or relay circuit or the like may be used for the switching means 21.

Figure 5:
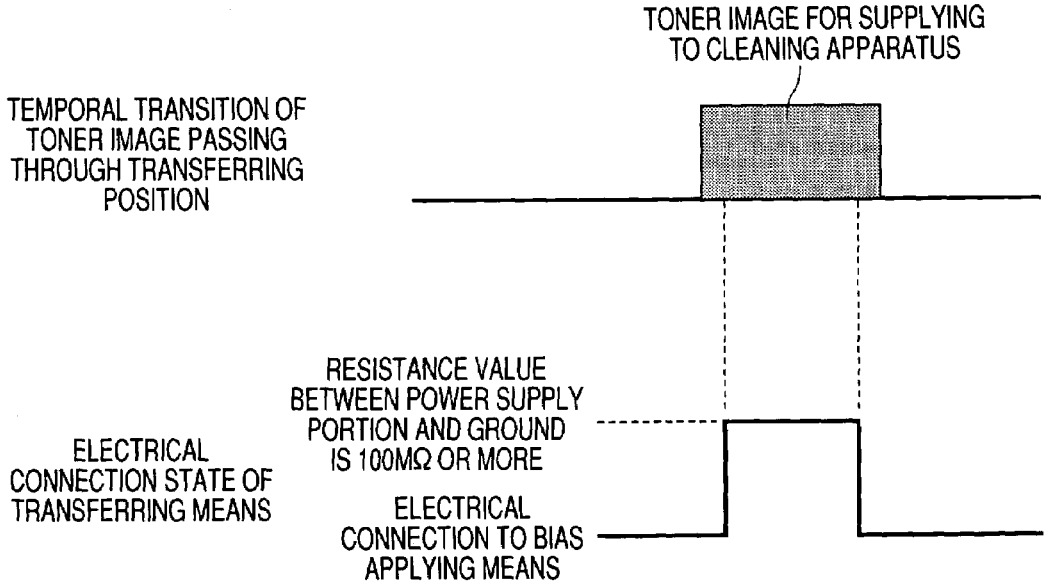
FIG. 5 is a view showing the switching timing of switching means in the image forming apparatus shown in FIG. 1.

Preferably a time period in which a resistance value between the ground and the power supply portion 110*a* of the primary transferring roller 110 is 100 MΩ is, as shown in FIG. 5, within a period in which a toner image for supply to the cleaning apparatus 6 on the photosensitive drum 1 passes through the nip (transferring position) between the photosensitive drum 1 and the primary transferring roller 110.

When the power supply to the power supply portion 110*a* of the primary transferring roller 110 is merely made to be 0 V, the ratio of the entire toner amount of the toner image for supply to the cleaning apparatus 6 on the photosensitive drum 1 that is not transferred by the primary transferring roller 110 and arrives at the cleaning apparatus 6 is only in the range of 10 to 50%. However, when the resistance value between the ground and the power supply portion 110*a* of the primary transferring roller 110 is set as 100 MΩ, that ratio increases to 50 to 100%.

That is, during the period of a state 21*b* in which the resistance value between the ground and the power supply portion 110*a* of the primary transferring roller 110 is 100 MΩ, most of the toner arrives at the cleaning portion without being transferred, and in contrast, during a period when a primary transferring bias is in a conduction state, half or more of the toner image for supply to the cleaning apparatus 6 is transferred and only a small amount thereof remains on the drum. Needless to say that to conduct cleaning of the transferred toner at this time, the transferred toner must be removed by the belt cleaner 14.

Although the ratio of toner that is not transferred by the primary transferring roller 110 and arrives at the cleaning apparatus 6 can also be increased by applying to the power supply portion 110*a* of the primary transferring roller 110 a bias that is of reverse polarity to that applied at a time of normal image transfer, in this case a sizeable voltage will be necessary to obtain a level equivalent to the state 21*b* in which the resistance value between the ground and the power supply portion 110*a* of the primary transferring roller 110 is 100 MΩ, and a large and costly device will be required as the transfer power source S2. Further, as a result of the reverse bias, the surface of the photosensitive drum 1 will bear an electrical memory, and means may be required to remove that memory.

Therefore, in order to be able to supply to the cleaning apparatus 6 a sufficient amount of toner image for supply as a lubricant that arrives at the cleaning apparatus, it is possible to prevent the formation of rolling-up of the cleaning blade 6*a*.

Even when adopting the above-described system to an image forming apparatus that conducts direct transfer from a photosensitive drum to a recording material using a transferring roller to which a bias is applied, a similar operational effect can be obtained.

Figure 6:
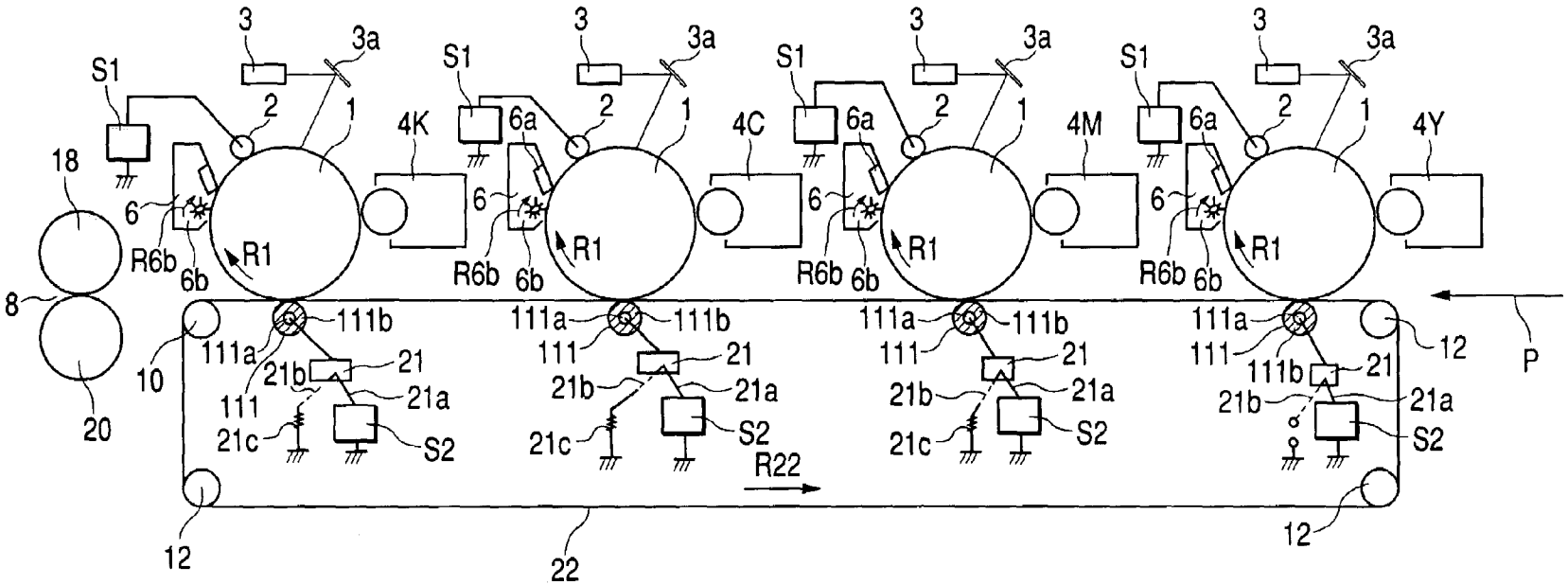
FIG. 6 is a longitudinal section that schematically shows an outline configuration of an image forming apparatus of this invention.

FIG. 6 shows another form of the image forming apparatus of this invention. The image forming apparatus shown in FIG. 6 has a plurality of photosensitive drums (image bearing members) 1. The toner images that are formed on each of the photosensitive drums 1 are directly transferred to a recording material that is carried on a recording material carrying member 22.

The process until the toner images are formed on each photosensitive drum 1 in the image forming apparatus shown in FIG. 6 is the same as that for the image forming apparatus shown in FIG. 1, and a description thereof is thus omitted herein.

When a transferring bias (bias) is applied from a transfer power source (bias applying means) S2 to a transferring roller (transferring means) 111, the toner images formed on the respective photosensitive drums 1 are transferred to a recording material P that is carried on the recording material carrying member 22 that rotates in the direction of an arrow R22 shown in FIG. 6. The transferring roller 111 has the same form as the primary transferring roller 110 used in the image forming apparatus shown in FIG. 1. More specifically, the transferring roller 111 comprises as a power supply portion 111*a*, a conductive material 111*b* such as foamed urethane provided around a cylindrical member made of metal to form a roller-shaped member.

When the toner images are transferred to the recording material P carried on the recording material carrying member 22 by the transferring roller 111, the power supply portion 111*a* of the transferring roller 111 is in a state where it is electrically connected to a transfer power source S2.

The recording material P onto which the toner images were transferred is then detached from the recording material carrying member 22. Subsequently, the recording material P is heated and pressed by a fixing apparatus 8 to fix the toner images to the surface of the recording material P. Thus, a color image is formed thereon.

Meanwhile, the toner (residual transfer toner) 23 that remains on the surface of the photosensitive drum 1 after transfer is cleaned and removed by the cleaning blade 6*a* and the fur brush 6*b* of the cleaning apparatus 6.

In the image forming apparatus shown in FIG. 6, as with the image forming apparatus shown in FIG. 1, at a time when an image is not being formed, a toner image (toner image for supply) as a lubricant of the photosensitive drum 1 and the cleaning apparatus 6 is formed on the photosensitive drum 1 by charging the photosensitive drum 1 (image bearing member) by means of the primary charging device (charging means) 2 to form an electrostatic image on the photosensitive drum 1 by means of the exposing apparatus (exposing means) 3 to develop the electrostatic image using toner from the developing apparatus (developing means) 4. Further, by rotation of the photosensitive drum 1, the toner image for supply passes through the nip (transferring position) of the primary transferring roller 111 and the photosensitive drum 1 and is supplied to the cleaning apparatus (cleaning means) 6.

In order to allow the toner image for supply on the photosensitive drum 1 (the toner amount on the photosensitive drum 1 is 0.05 mg/cm$^2$ or more over the total area for which image formation is possible in the longitudinal direction of the photosensitive drum 1 and over an arbitrary width in the direction of rotation of the photosensitive drum) to arrive at the cleaning blade 6*a* and the fur brush 6*b* of the cleaning apparatus (cleaning means) 6 without, as far as possible, transferring the toner image for supply to the recording material carrying member 22, during a period when the toner image for supply passes through the transferring position the apparatus enters a state 21*b* in which a resistance value between the power supply portion 111*a* and a ground is 100 MΩ, by means of the switching means 21 that switches from a state 21*a* in which the power supply portion 111*a* is electrically connected to the transfer power source S2 to the state 21*b* in which the resistance value between the power supply portion 111*a* and the ground is 100 MΩ.

In this embodiment, an electric resistance element 21*c* with a resistance of 100 MΩ is provided between the ground and the power supply portion 111*a*.

Figure 8:
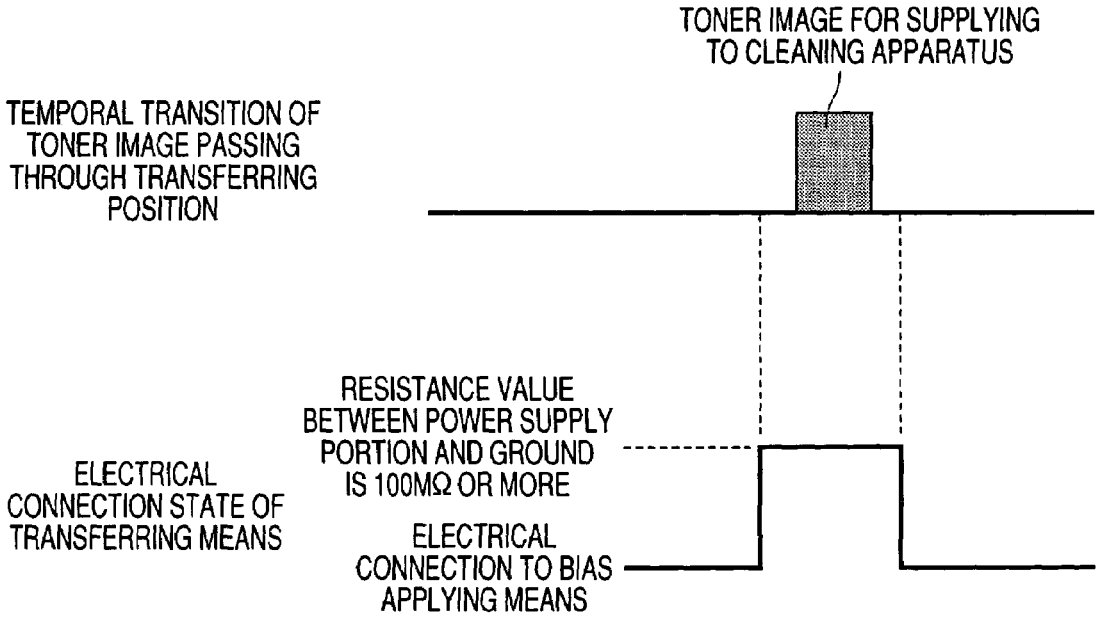
FIG. 8 is a view showing the switching timing of switching means in the image forming apparatuses shown in FIG. 6 and FIG. 7.

Preferably, the period of the state 21*b* during which a resistance value between the ground and the power supply portion 111*a* of the transferring roller 111 is 100 MΩ is, opposite to the image forming apparatus shown in FIG. 1, longer than a period in which a toner image for supply to the cleaning apparatus 6 on the photosensitive drum 1 passes through the transferring position, as shown in FIG. 8.

Figure 7:
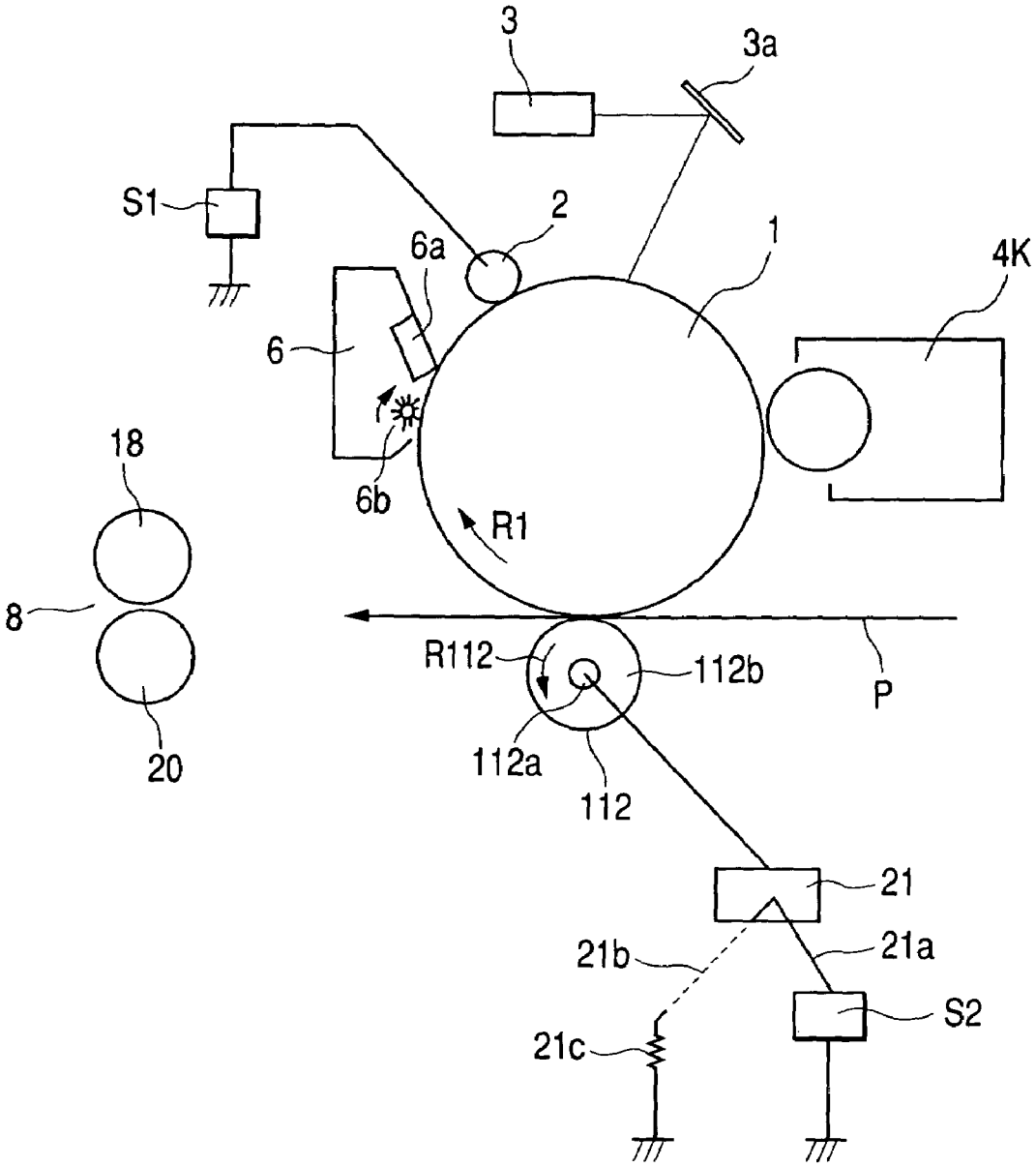
FIG. 7 is a longitudinal section that schematically shows an outline configuration of an image forming apparatus of this invention.

FIG. 7 shows still another form of the image forming apparatus of this invention. In the image forming apparatus shown in FIG. 7, a toner image formed on the photosensitive drum 1 is directly transferred to a recording material that is nipped between the photosensitive drum 1 and a transferring roller 112.

The process until the toner image is formed on the photosensitive drum 1 in the image forming apparatus shown in FIG. 7 is also the same as that for the image forming apparatus shown in FIG. 1, and a description thereof is thus omitted here.

When a transferring bias (bias) is applied from the transfer power source (bias applying means) S2 to a power supply portion 112*a* of the transferring roller (transferring means) 112, a toner image formed on the photosensitive drum 1 is transferred to the recording material P that is nipped between the photosensitive drum 1 and the transferring roller 112 that rotates in the direction of an arrow R112 shown in FIG. 7.

The transferring roller 112 has the same form as the primary transferring roller 110 used in the image forming apparatus shown in FIG. 1. More specifically, the transferring roller 112 comprises as a power supply portion 112*a*, a conductive material 112*b* such as foamed urethane provided around a cylindrical member made of metal to form a roller-shaped member.

Further, when the toner image is transferred to the recording material P by the transferring roller 112, the power supply portion 112*a* of the transferring roller 112 is in a state where it is electrically connected to the transfer power source S2.

The recording material onto which the toner image was transferred is subsequently heated and pressed by the fixing apparatus 8 to fix the toner image to the surface of the recording material P. Thus, an image is formed thereon.

Meanwhile, the toner (residual transfer toner) 23 that remains on the surface of the photosensitive drum 1 after the transfer is cleaned and removed by the cleaning blade 6*a* and the fur brush 6*b* of the cleaning apparatus 6.

In the image forming apparatus shown in FIG. 7, similarly to the image forming apparatuses shown in FIG. 1 and FIG. 6, at a time when an image is not being formed, a toner image (toner image for supply) as a lubricant of the photosensitive drum 1 and the cleaning apparatus 6 is formed on the photosensitive drum 1 by charging the photosensitive drum 1 (image bearing member) by means of the primary charging device (charging means) 2 to form an electrostatic image on the photosensitive drum 1 by means of the exposing apparatus (exposing means) 3 to develop the electrostatic image using toner from the developing apparatus (developing means) 4. Further, by rotation of the photosensitive drum 1, the toner image for supply passes through the nip (transferring position) between the transferring roller 112 and the photosensitive drum 1 and is supplied to the cleaning apparatus (cleaning means) 6.

In order to allow the toner image for supply on the photosensitive drum 1 (the toner amount on the photosensitive drum 1 is 0.05 mg/cm$^2$ or more over the total area for which image formation is possible in the longitudinal direction of the photosensitive drum 1 and over an arbitrary width in the direction of rotation of the photosensitive drum) to arrive at the cleaning blade 6*a* and the fur brush 6*b* of the cleaning apparatus (cleaning means) 6 without, as far as possible, transferring the toner image for supply to the transferring roller 112, during a period when the toner image for supply passes through the transferring position the apparatus enters a state 21*b* in which a resistance value between the power supply portion 112*a* and the ground is 100 MΩ, by means of the switching means 21 that switches from a state 21*a* in which the power supply portion 112*a* is electrically connected to the transfer power source S2 to the state 21*b* in which the resistance value between the power supply portion 112*a* and the ground is 100 MΩ.

In this embodiment, an electric resistance element 21*c* with a resistance of 100 MΩ is provided between the ground and the power supply portion 112*a*.

As with the image forming apparatus shown in FIG. 6, preferably the period of the state 21*b* during which the resistance value between the ground and the power supply portion 112*a* of the transferring roller 112 is 100 MΩ is, as shown in FIG. 8, longer than a period in which the toner image for supply to the cleaning apparatus 6 on the photosensitive drum 1 passes through the transferring position.

Embodiment 2

Next, another example of the image forming apparatus of this invention is described as the second embodiment thereof.

The overall configuration of this apparatus is the same as that in Embodiment 1.

A toner image for supply to the cleaning apparatus 6 in which the toner amount on the photosensitive drum 1 is 0.05 mg/cm$^2$ or more over the total area for which image formation is possible in the longitudinal direction of the photosensitive drum 1 and over an arbitrary width in the direction of rotation of the photosensitive drum, as described in Embodiment 1, comprises a much larger toner amount in comparison to the case where residual transfer toner comes to the cleaning apparatus 6 during normal image formation.

Consequently, while it is a necessary item for the cleaning apparatus 6, when the toner amount is large the situation is less advantageous from the viewpoint of cleaning capability, and therefore to enable stable cleaning it is appropriate to slow the movement speed of the surface of the photosensitive drum 1 to less than the normal speed for image formation. This effect applies equally to the image forming apparatuses shown in FIG. 1, FIG. 6 and FIG. 7.

In practice, conventional image formation is achieved more effectively in image forming apparatuses are considerably fast.

Therefore, in order to be able to supply to the cleaning apparatus 6 a sufficient amount of toner image for supply as a lubricant that arrives at the cleaning apparatus, it is possible to prevent the formation of rolling-up of the cleaning blade 6*a*.

This application claims priority from Japanese Patent Application No. 2003-330056 filed Sep. 22, 2003, which is hereby incorporated by reference herein.

What is claimed is:

1. An image forming apparatus having:

an image bearing member bearing a toner image;

an intermediate transferring material that contacts with said image bearing member;

transferring means that transfers a toner image on said image bearing member to the intermediate transferring material at a transferring position;

bias applying means that applies a bias to a power supply portion of said transferring means during a period in which a transfer is performed by said transferring means;

cleaning means that contacts with said image bearing member to clean a surface of said image bearing member;

toner supplying means that, at a time when an image is not being formed, passes a toner image for supply formed on said image bearing member through the transferring position to supply the toner image for supply to said cleaning means; and switching means that switches from a first state in which said power supply portion is electrically connected to said bias applying means to a second state in which a resistance value between said power supply portion and a ground is equal to or greater than 100 MΩ, wherein, when the toner image for supply on said image bearing member passes through the transferring position, said switching means has switched from the first state to the second state.

2. The image forming apparatus according to claim 1, wherein said transferring means contacts with said intermediate transferring material.

3. The image forming apparatus according to claim 2, wherein said cleaning means includes a blade member that contacts with said image bearing member.

4. The image forming apparatus according to claim 3, wherein a movement speed of the surface of said image bearing member at a time of formation of the toner image for supply by said toner supplying means is slower than a movement speed of the surface of said image bearing member at a time of normal image formation by said image forming apparatus.

5. An image forming apparatus having:

an image bearing member bearing a toner image;

a recording material carrying member that carries a recording material and can contact with said image bearing member;

transferring means that transfers a toner image on said image bearing member to a recording material carried on said recording material carrying member at a transferring position;

bias applying means that applies a bias to a power supply portion of said transferring means during a time period in which transfer is performed by said transferring means;

cleaning means that comes into contact with said image bearing member to clean a surface of said image bearing member;

toner supplying means that, at a time when an image is not being formed, passes a toner image for supply formed on said image bearing member through the transferring position to supply the toner image for supply to said cleaning means; and switching means that switches from a first state in which said power supply portion is electrically connected to said bias applying means to a second state in which a resistance value between said power supply portion and a ground is equal to or greater than 100 MΩ, wherein, when the toner image for supply on said image bearing member passes through the transferring position, said switching means has switched from the first state to the second state.

6. The image forming apparatus according to claim 5, wherein said recording material carrying member contacts with said image bearing member at a time when an image is not being formed.

7. The image forming apparatus according to claim 6, wherein said transferring means contacts with said recording material carrying member.

8. The image forming apparatus according to claim 7, wherein said cleaning means includes a blade member that contacts with said image bearing member.

9. The image forming apparatus according to claim 8, wherein a movement speed of the surface of said image bearing member at a time of formation of the toner image for suppiy by said toner supplying means is slower than a movement speed of the surface of said image bearing member at a time of normal image formation by said image forming apparatus.

10. An image forming apparatus having:

an image bearing member bearing a toner image;

transferring means that transfers a toner image on said image bearing member to a recording material at a transferring position;

bias applying means that applies a bias to a power supply portion of said transferring means during a time period in which a transfer is performed by said transferring means;

cleaning means that contacts with said image bearing member to clean a surface of said image bearing member;

toner supplying means that, at a time when an image is not being formed, passes a toner image for supply formed on said image bearing member through the transferring position to supply the toner image for supply to said cleaning means; and switching means that switches from a state in which said power supply portion is electrically connected to said bias applying means to a state in which a resistance value between said transferring means and a ground is equal to or greater than 100 MΩ, wherein a state when the toner image for supply on said image bearing member passes through the transferring position is said state where the resistance value is equal to or greater than 100 MΩ.

11. The image forming apparatus according to claim 10, wherein said transferring means contacts with said image bearing member at a time when an image is not being formed.

12. The image forming apparatus according to claim 11, wherein said cleaning means includes a blade member that contacts with said image bearing member.

13. The image forming apparatus according to claim 12, wherein a movement speed of the surface of said image bearing member at a time of formation of the toner image for supply by said toner supplying means is slower than a movement speed of the surface of said image bearing member at a time of normal image formation by said image forming apparatus.

* * * * *